US006523622B1

(12) United States Patent
Berger et al.

(10) Patent No.: US 6,523,622 B1
(45) Date of Patent: Feb. 25, 2003

(54) PNEUMATIC PERCUSSION POWER TOOL WITH PNEUMATIC RETURNING SPRING

(75) Inventors: Rudolf Berger, Grünwald (DE); Wolfgang Schmid, München (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 09/674,968

(22) PCT Filed: Aug. 13, 1999

(86) PCT No.: PCT/EP99/05937

§ 371 (c)(1),
(2), (4) Date: Nov. 7, 2000

(87) PCT Pub. No.: WO00/16948

PCT Pub. Date: Mar. 30, 2000

(30) Foreign Application Priority Data

Sep. 23, 1998 (DE) ..... 198 43 642

(51) Int. Cl.[7] ..... B25D 9/00

(52) U.S. Cl. ..... 173/212; 173/201; 173/131; 173/132

(58) Field of Search ..... 173/14, 91, 131, 173/132, 212, 201

(56) References Cited

U.S. PATENT DOCUMENTS

| | | | | | |
|---|---|---|---|---|---|
| 4,602,689 | A | * | 7/1986 | Wanner | 173/127 |
| 4,624,325 | A | * | 11/1986 | Steiner | 173/133 |
| 4,683,960 | A | * | 8/1987 | Kostylev et al. | 173/206 |
| 4,759,260 | A | * | 7/1988 | Lew | 91/394 |
| 4,828,046 | A | * | 5/1989 | Pyatov | 173/14 |
| 4,932,479 | A | * | 6/1990 | Pyatov | 173/14 |
| 5,108,400 | A | | 4/1992 | Appel et al. | 606/79 |
| 5,161,623 | A | * | 11/1992 | Erlach | 173/14 |

* cited by examiner

*Primary Examiner*—Scott A. Smith
*Assistant Examiner*—Chukwurah Nathaniel
(74) *Attorney, Agent, or Firm*—Boyle Fredrickson Newholm Stein & Gratz S.C.

(57) ABSTRACT

A pneumatic percussion power tool has a percussion tool housing in which a drive piston and a percussion piston are movable in an axial direction. The motion of the drive piston, which is generated by a crank mechanism, is transmitted to the percussion piston through a pneumatic spring in a first chamber so that the percussion piston cyclically strikes a ram or a tool. The backward motion of the percussion piston rebounding from the ram is supported by increasing air pressure in a third chamber that is supplied with air by the drive piston through a second chamber and a communicating channel.

15 Claims, 5 Drawing Sheets

PNEUMATIC PERCUSSION POWER TOOL WITH PNEUMATIC RETURNING SPRING

BACKGROUND OF THE INVENTION

1. Field of the Invention

This invention pertains to a pneumatic impact mechanism in which a drive piston and a percussion piston move axially within an impact mechanism housing.

2. Description of the Related Art

These types of impact mechanisms are commonly used in hammer drills and sledgehammers and in practice two types of impact mechanisms have proven useful, among others. The first type consists of an impact mechanism with a hollow drive piston moved inside the impact mechanism housing, in the cavity of which the percussion piston is moved. The other type consists of an impact mechanism with a hollow percussion piston moved inside the impact mechanism housing, in the cavity of which the drive piston is moved. The commonality of both impact mechanism types is that the drive piston is driven by a crankshaft, for example, and that a pneumatic spring is created between the drive is piston and the percussion piston that transfers the drive motion of the drive piston onto the percussion piston and forces it in a direction of impact where it finally meets a tool, for example a chisel, transferring its impact energy onto it. Afterward, the percussion piston rebounds and another impact motion starts, supported by the drive piston.

The advantages of the impact mechanism types described are in their minimal requirements with regard to sealing of the separating joints so that robust steel-steel glide pairs can be used in the high pressure range without using additional sealing elements. Moreover, the impact mechanisms exhibit good startup behavior at low temperatures.

Nevertheless, under certain operating conditions, the problem arises in that, after an impact, the return motion of the percussion piston is not sufficient to make a forceful impact, despite the recoil impulse and the suction effect of the drive piston.

OBJECTS AND SUMMARY OF THE INVENTION

The objective of the invention is to provide a pneumatic impact mechanism in which the recoil behavior of the percussion piston is improved.

According to the invention, the objective is met by means of a pneumatic impact mechanism with a impact mechanism housing, a drive piston that is driven axially back and forth, an axially moving percussion piston located in front of a drive surface of the drive piston coaxial to the drive piston as seen in an impact direction, a first chamber in front of the drive surface of the drive piston and located behind a rear surface of the percussion piston, a second chamber located behind the drive surface of the drive piston and with a third chamber located in front of the rear surface of the percussion piston, wherein the second chamber and the third chamber can be made to communicate with one another by means of a connection channel.

The design of the pneumatic impact mechanism enables the drive piston, when it makes a forward motion, to transfer its energy to the percussion piston through a pneumatic spring created in the first chamber, thus transferring its energy indirectly onto the tool. When the drive piston makes a backward motion, air pressure forms in the second chamber located behind the drive piston. This air pressure is passed through the connection channel to the third chamber in front of the percussion piston. In this way, when the drive piston is moved backward, the return motion of the percussion piston is supported independent of its recoil after the impact and independent of the suction effect of the drive piston transferred by the first chamber. A reliable return motion of the percussion piston is the result even under difficult operating conditions, so that when the drive piston repeats its forward motion, another forceful impact can be made.

The communication between the second chamber and the third chamber enables the pressure change in the second chamber caused by the motion of the drive piston to change the pressure in the third chamber by means of the connection channel.

In a first preferred embodiment form of the invention, the drive piston is moved inside the impact mechanism housing whereas the percussion piston is moved inside a cavity formed at one end of the drive piston.

Alternatively, in another very advantageous embodiment form, the percussion piston is moved inside the impact mechanism housing whereas the drive piston is moved inside a cavity formed in an end face. The solution according to the invention is suitable for both of the pneumatic impact mechanisms mentioned.

In a preferred development of the invention, the second chamber is located between a rear surface of the drive piston and a rear tubular base fastened to the impact mechanism housing, whereas the third chamber is located between a forward surface of the percussion piston and a rear tubular base fastened to the impact mechanism housing. This enables additional chambers, as compared to the state of the technology, to be created behind the drive piston and in front of the percussion piston without expensive additional design measures.

In the process, the drive piston is designed such that it has a piston head that constitutes both the drive surface and the rear surface, a bracket with which to fasten to a drive unit and a center member that connects the piston head to the bracket. This design makes it possible to locate the tubular base between the piston head and the bracket, which creates the second chamber in a simple manner.

In another advantageous configuration of the invention, an idle channel is provided that has at least one idle opening provided in a wall of the drive piston and which penetrates a wall of the impact mechanism housing. The idle channel is connected either to the connection channel or the outside. Through the idle channel, it is possible to short circuit the first and second chambers so that no pressure relationship can form in the pneumatic impact mechanism that acts on the percussion piston when the pneumatic impact mechanism is at idle.

In an especially advantageous embodiment form, a shifting control slide is provided that can switch between an impact position and an idle position. When it is in the impact position, it creates the connection between the second and third chambers by means of the connection channel while blocking the idle channel. In the idle position, it blocks off the connection channel and opens the idle channel, thus precisely bringing about the transfer between idle and impact positions. It is advantageous here to carry out the axial shifting of the control slide by coupling the control slide to the tool or to the die located between the percussion piston and the tool. When switching to idle, the tool or the die slides somewhat forward out of the housing when lifted away from the rock, with the control slide also following this motion.

BRIEF DESCRIPTION OF THE DRAWINGS

This and other advantages and features of the invention are explained in more detail below with the aid of the accompanying figures. Shown are.

DETAILED DESCRIPTION OF THE PREFERRED EMBODIMENTS

Figure 1:
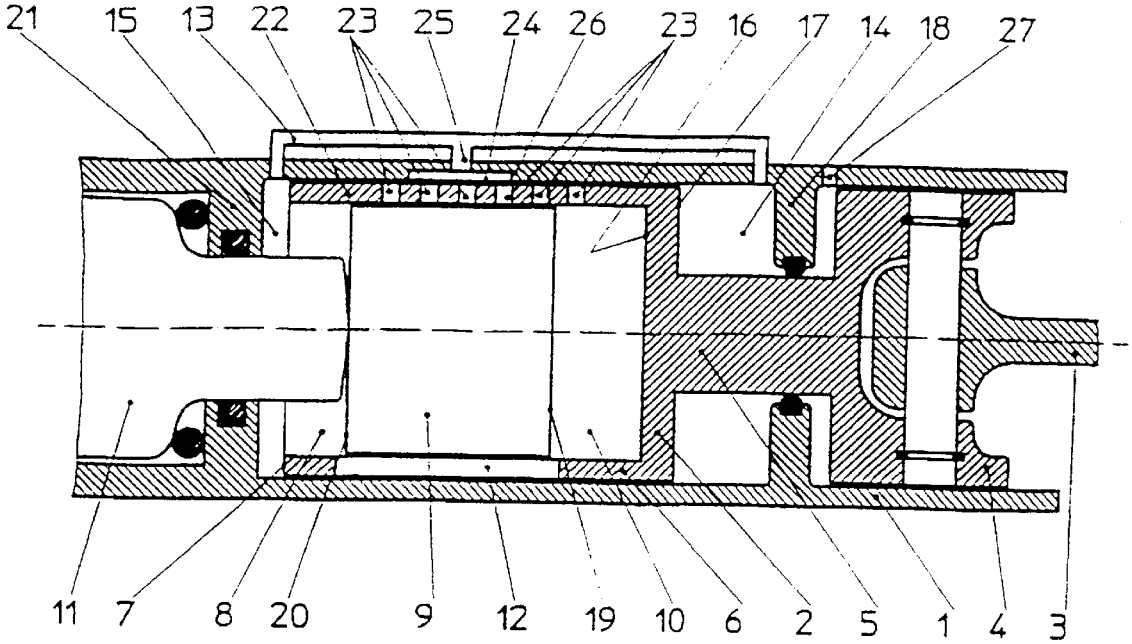
FIG. 1 a schematic sectional illustration of a pneumatic impact mechanism according to the invention in the impact position.
Figure 2:
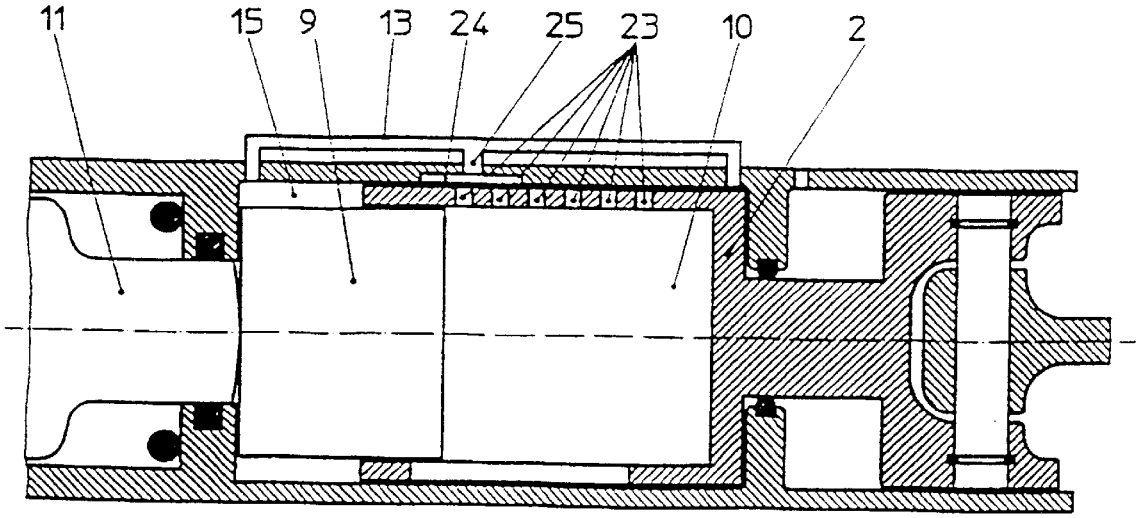
FIG. 2 the impact mechanism of FIG. 1 in the idle position.

FIGS. 1 and 2 show a pneumatic impact mechanism according to the invention in the impact and idle position, respectively.

In an impact mechanism housing 1, a drive piston 2 is shifted in an oscillating axial motion by means of a connecting rod 3 belonging to a crankshaft drive of known design, which is not shown.

The connecting rod 3 is hinged to a bracket 4 of the drive piston 2. The bracket 4 is connected to a piston head 6 in one piece through a center member 5. The drive piston 2 thus consisting of the bracket 4, the center member 5 and the piston head 6 can also be constructed out of a number of parts—different than what is shown in the figure—if it is sensible to do so for manufacturing or assembly reasons.

A cavity 8 is formed in a forward end 7 of the drive piston 2. A percussion piston 9 that can move axially is inserted into this cavity. Between the drive piston 2 and the percussion piston 9 is a first chamber 10 that is enclosed by the drive piston 2 and that contains air at ambient pressure in the initial state.

At the beginning of an impact, the drive piston 2 moves forward, i.e.—with reference to FIGS. 1 and 2—to the left. Due to inertia, the percussion piston 9 follows in a delayed manner, resulting in the increase in air pressure in the first chamber 10 so that a pneumatic spring results, which transfers its energy in delayed fashion to the percussion piston 9. This is finally accelerated forward as well and impacts a die 11, shown only schematically, wherein the motive energy of the impact piston 9 is transferred as impact energy. The die 11 conveys the impact energy to a tool, not shown, for example a chisel. In place of the die 11, a stem of the tool can be employed directly as well.

At the point of impact shown in FIG. 1, an air equalization channel 12 in the wall of the drive piston 2 is opened, whereupon the first chamber 10 can be ventilated and air losses can be equalized in a known fashion.

After the impact, the percussion piston 9 rebounds back in the direction of the drive piston 2, which is already in its return motion as well due to the crankshaft drive. Due to a negative pressure forming in the first chamber 10, the return motion of the percussion piston 9 is aided until the drive piston 2 again makes its forward motion and begins a new impact cycle.

In impact mechanisms known from the state of the technology it turns out that for certain operating conditions, the return motion of the percussion piston proceeds unsatisfactorily and is not sufficiently supported by the suction effect in the first chamber. This results in the percussion piston not returning back far enough and the next impact not being made with the required energy. An unsatisfactory working result and irregular behavior of the hammer is the result for the user.

The problem is solved according to the invention in that a connection channel 13 is provided that causes a second chamber 14 to communicate with a third chamber 15.

The second chamber 14 is located behind a drive surface 16 of the drive piston 2—as seen in the direction of impact. As seen in FIGS. 1 and 2, the second chamber 14 is formed by a rear surface 17 provided at the piston head 6, a rear tubular base 18 belonging to the impact mechanism housing 1, the center member 5 and the actual impact housing 1.

The third chamber 15 is located in front of a rear surface 19 of the percussion piston 9 and is formed by an impact surface 20 of the percussion piston 9 serving as a front surface, a front tubular base 21 belonging to the impact mechanism housing 1, the actual impact mechanism housing 1 and the drive piston 2.

It is not usually necessary to seal the various separating joints between the moving parts. Here, steel-steel glide pairs are commonly used.

When the drive piston 2 is shifted backward after an impact, a negative pressure is produced not just in the first chamber 10—as is known in the state of the technology—to pull the percussion piston 9 back. In the second chamber 14, a positive pressure arises that leads to the third chamber 15 through the connection channel 13 and acts on the impact surface 20 of the percussion piston 9 at that location. Support of the rearward motion of the percussion piston 9 is the result. In reverse, the forward motion of the percussion piston 9 is also boosted when the drive piston 2 makes its forward motion since the negative pressure arising in the second chamber 14 is also passed on to the third chamber 15.

The function of the first chamber 10 formed between the drive surface 16 of the drive piston 2 and the rear surface 19 of the percussion piston 9 is thus not affected.

In a wall 22 of the drive piston 2, there are a number of idle openings 23 that move back and forth in front of an idle notch 24 designed into the impact mechanism housing 1 when the drive piston 2 is moved axially. The idle notch 24 is connected through an air channel 25 to the connection channel 13. The idle openings 23, the idle notch 24 and the air channel 25 together form an idle channel.

The impact mechanism goes into idle when the user of the hammer drill or sledgehammer employing the impact mechanism lifts the tool from the rock he is working on. In doing so, the tool and the die 11 slide by a certain amount out of the impact mechanism housing 1. The percussion piston 9 follows and comes to rest in the position shown in FIG. 2. In so doing, the percussion piston 9 passes by an area of an edge 26 in the housing, and produces a connection between the first chamber 10 through the idle openings 23, the idle notch 24 and the air channel 25 to the connection channel 13.

By producing the connection between the first chamber 10 and the second chamber 14 or the third chamber 15, the air system is short-circuited. This means that when the drive piston 2 continues to move, the air is pumped out of the second chamber 14 into not only the third chamber 15—as in impact operation—but also into the first chamber 10 where it provides air equalization and thus, for the most part, even air pressure in all three chambers. The percussion piston 9 is thus not forced from its forward-most position.

For the purposes of completeness, another ventilation opening 27 is mentioned, by means of which a possible air cushion that can arise between the rear tubular base 18 and the bracket 4 can be discharged.

Figure 3:
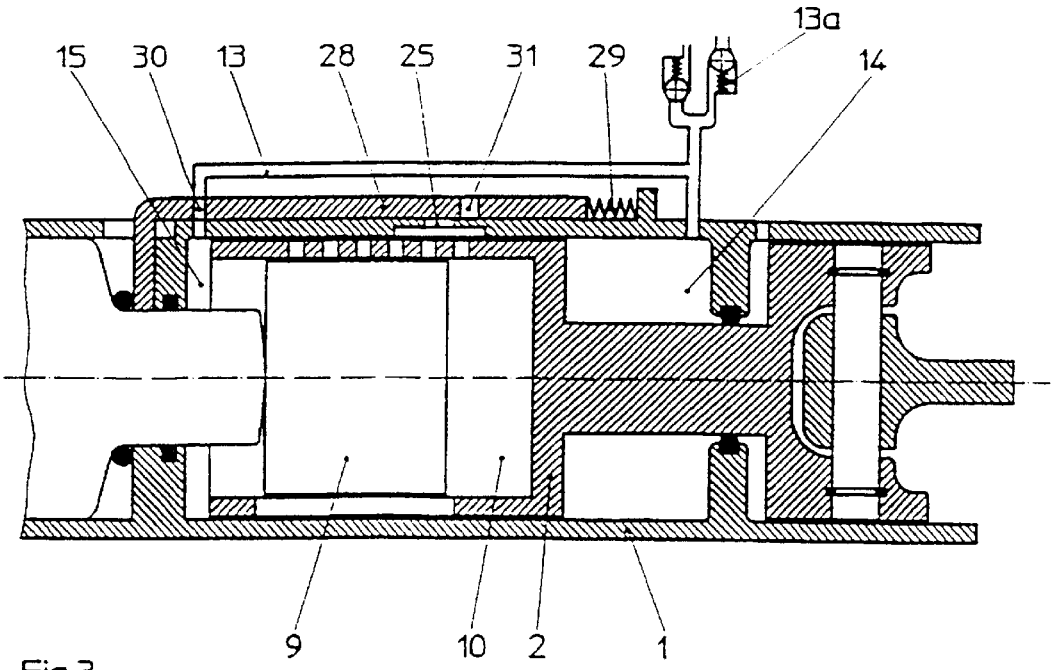
FIG. 3 a schematic sectional illustration of a second embodiment form of the pneumatic impact mechanism according to the invention in the impact position.
Figure 4:
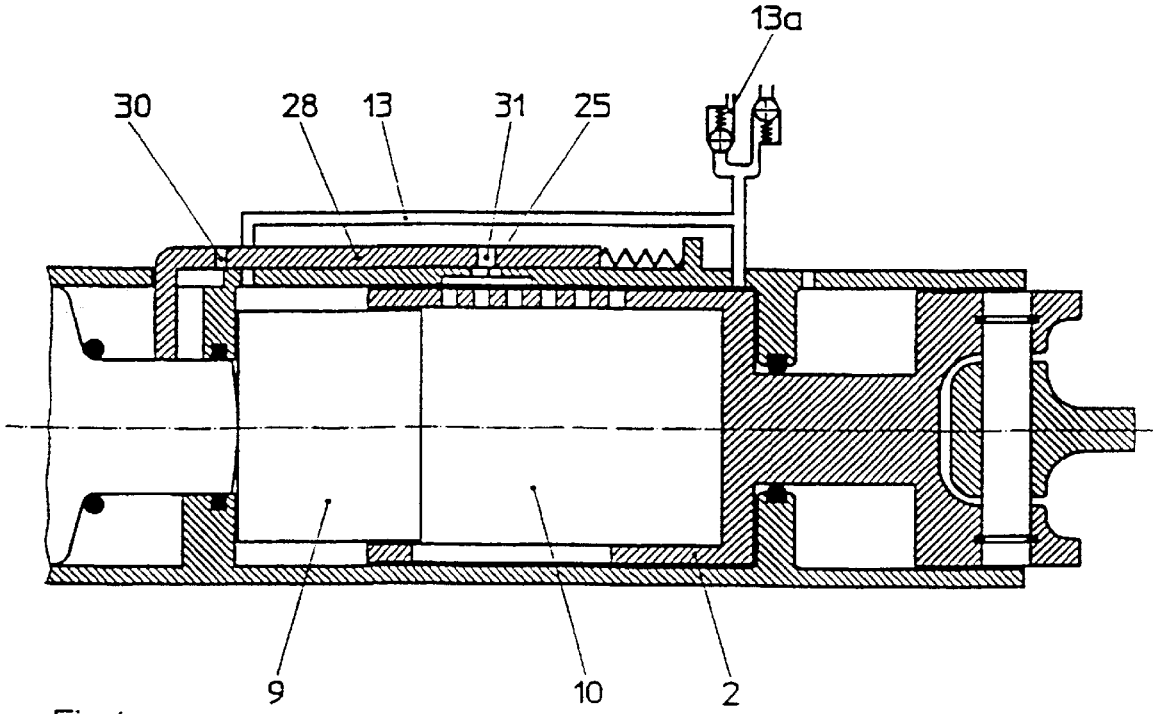
FIG. 4 the impact mechanism according to FIG. 3 in the idle position.

FIGS. 3 and 4 show schematically a sectional illustration of a second embodiment form of the invention. The same parts as those in the first embodiment form are identified with the same labels, and their description is not repeated here.

In comparison to the first embodiment form of the invention shown in FIGS. 1 and 2, the second embodiment form is provided with an axially shifting control slide 28 that is tensioned on one side by a spring 29 supported against the impact mechanism housing 1. The control slide 28 can be shifted between an impact position shown in FIG. 3 and an idle position shown in FIG. 4, depending on the position of the die 11.

A connection opening 30 and an idle opening 31 are provided in the control slide 28. In the impact position, the control slide 28 is located in a position at which the connection opening 30 allows a connection between the connection channel 13 and the third chamber 15, whereas the control slide 28 prevents a connection of the first chamber 10 to the outside by the fact that the idle opening 31 is not sitting over the air channel 25.

When switching between impact and idle operation, the die 11, the percussion piston 9 and the control slide 28 slide by a specific amount in the direction of the tool, whereupon the connection opening 30 blocks off the connection channel 13 while the idle opening 31 is shifted over the air channel 25. This allows the first chamber 10 to be connected to the outside, allowing idle behavior to take place.

Indeed, the use of the control slide 28 requires more mechanical hardware, but has the advantage in that the idle path, i.e. the path by which the tool must slide out of the impact mechanism housing 1, can be shortened. This reflects in a shorter design.

As seen in FIG. 4, air pressure forms in the second chamber 14 when the drive piston 2 makes its return motion. This air pressure cannot be discharged through the connection channel 13. To prevent extreme pressures, therefore, a dual-acting pressure relief valve 13*a* is provided in the connection channel 13.

A variation to this is shown as a third embodiment form in FIGS. 5 and 6, again in the impact and idle positions. This third embodiment form differs from the second embodiment form according to FIGS. 3 and 4 in that the control slide 28 has a larger axial length and extends across the area of the second chamber 14.

In the control slide 28, in addition to the connection opening 30 and the idle opening 31, there is a connection opening 32 and a ventilation opening 33.

Figure 5:
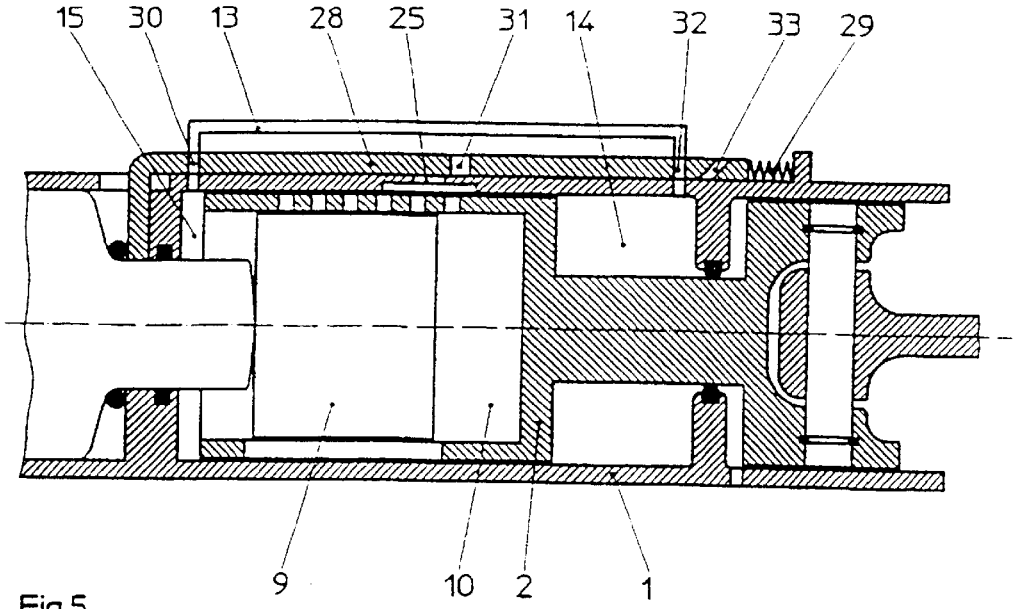
FIG. 5 a third embodiment form of a pneumatic impact mechanism according to the invention in the impact position.
Figure 6:
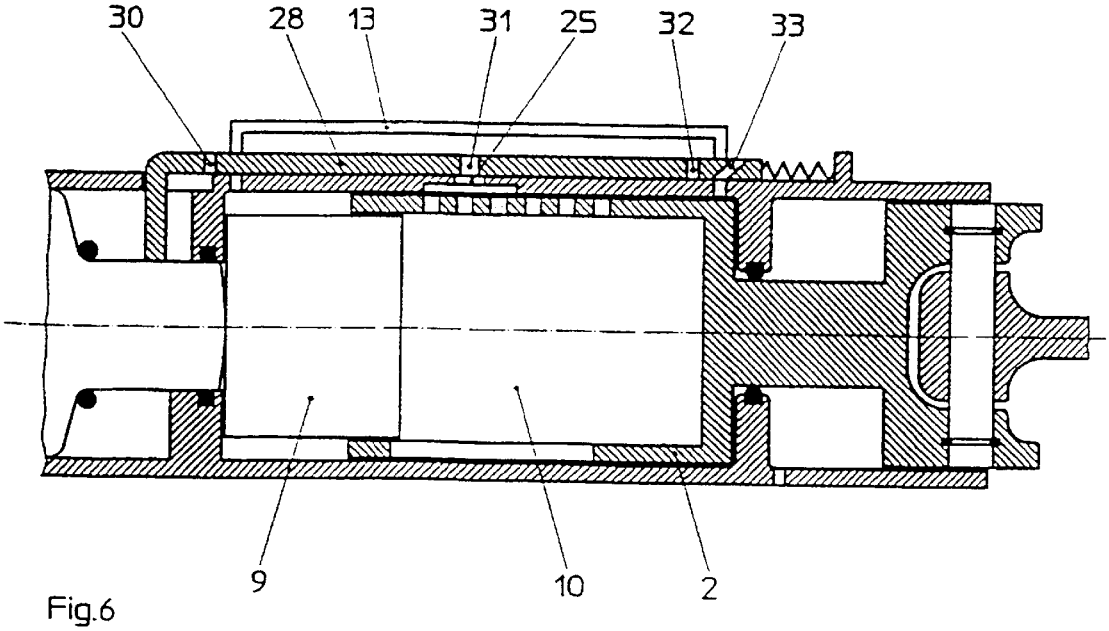
FIG. 6 the impact mechanism according to FIG. 5 in the idle position.

As seen in FIGS. 5 and 6, this allows the control slide 28 to control all openings to the first chamber 10, the second chamber 14, and the third chamber 15. If the control slide 28 is in the impact position shown in FIG. 5, it causes the second chamber 14 and the third chamber 15 to communicate with one another by means of the connection channel 13 using the connection openings 30 and 32.

In the idle position, the control slide 28 is moved forward, whereupon the idle opening 31 moves over the air channel 25 and produces a connection between the first chamber 10 and the outside in order to prevent a pressure build-up in the first chamber 10. Further, a connection between the second chamber 14 and the outside is produced by means of the air opening 33 so that the second chamber 14 can ventilate without air having to be discharged through the connection channel 13 or an increased air pressure arising in the connection channel 13.

Figure 7:
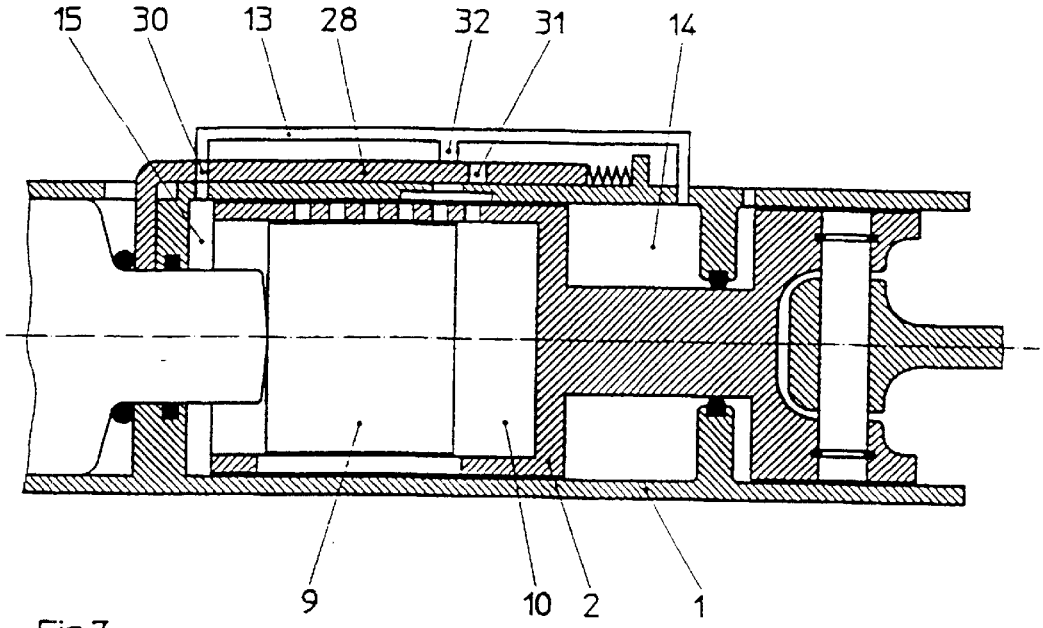
FIG. 7 a fourth embodiment form of a pneumatic impact mechanism according to the invention in the impact position.
Figure 8:
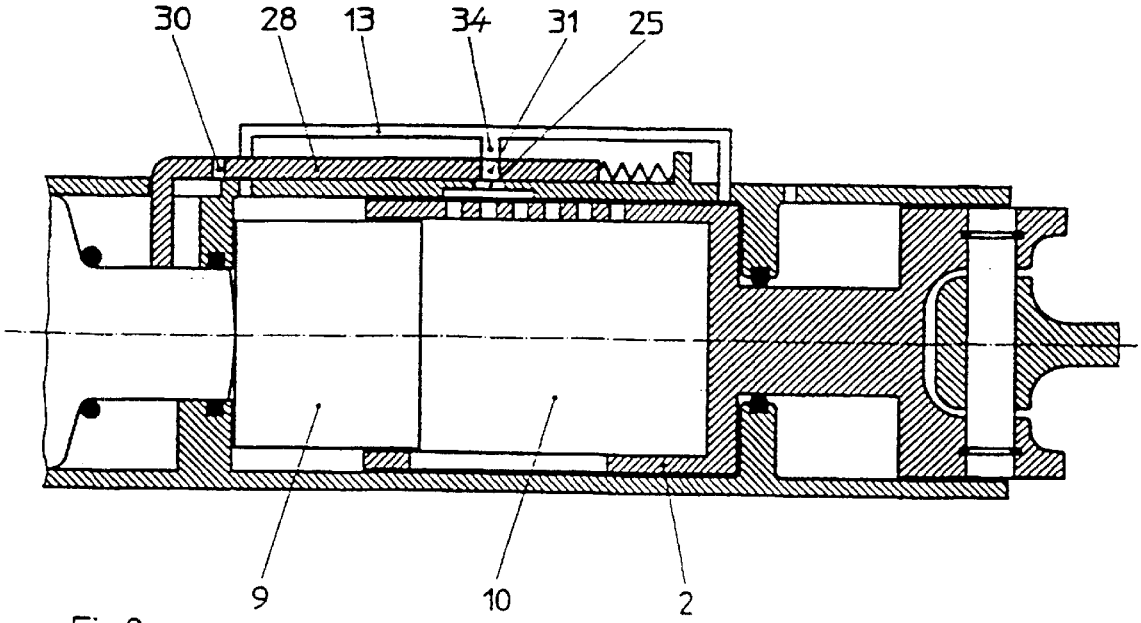
FIG. 8 the impact mechanism according to FIG. 7 in the idle position.

Alternatively, another, fourth embodiment form is suggested as shown in FIGS. 7 and 8, which differs from that in FIGS. 3 through 6 in that the connection channel 13 is tied by means of a connection section 34 to the idle opening 31 in the control slide 28.

This makes it possible—similar to FIGS. 1 and 2—to short-circuit the first and second chambers 10, 14 so that when the drive piston 2 makes a pumping motion no pressure increase in the first or second chamber 10, 14 occurs.

The third chamber 15 is separated from the connection channel 13 by means of the control slide 28 and thus experiences no pressure increase. The percussion piston 9 remains fixed in the position shown in FIG. 8 without being able to be lifted up by the drive piston 2.

Only when the user resets the tool onto the rock and thus shifts the die 11 backward are the percussion piston 9 and the control slide 28 also shifted backward, whereupon the impact operation returns.

Figure 9:
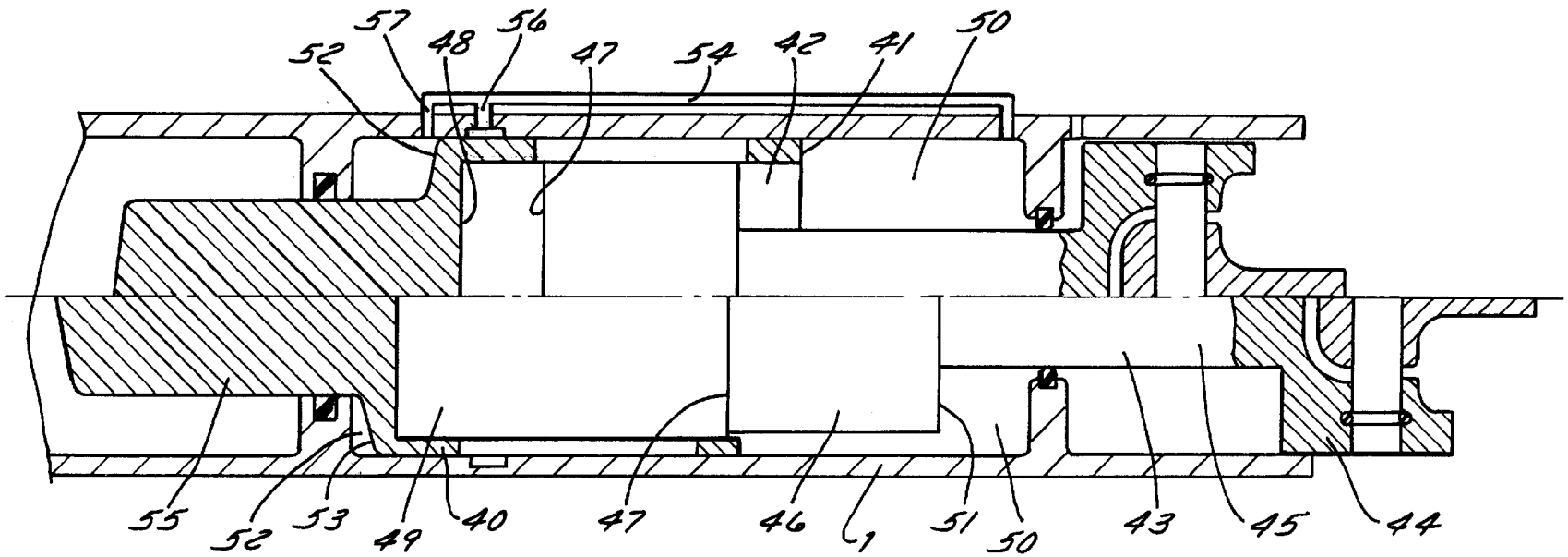
FIG. 9 another type of impact mechanism as the fifth embodiment form for a pneumatic impact mechanism according to the invention in the impact and idle positions.

FIG. 9 shows another type of pneumatic impact mechanism according to the invention as a fifth embodiment form in which a percussion piston 40 is moved inside an impact mechanism housing 1 axially. In the upper half of FIG. 9, the impact mechanism is shown in the impact position, whereas the lower half of FIG. 9 shows the impact mechanism in the idle position.

At a rear end 41 of the percussion piston 40, a cavity 42 is formed in which a drive piston 43 is moved.

The drive piston 43 is constructed in a similar manner as in the previous embodiment forms and consists essentially of a bracket 44, a center member 45 and a piston head 46.

Between a drive surface 47 of the drive piston 43 and a rear surface 48 of the percussion piston 40, a first chamber 49 is formed.

Analogous to the embodiment forms already described, a second chamber 50 is formed behind a rear surface 51 of the drive piston 43 as is a third chamber 52 in front of a front surface 53 of the percussion piston 40. The second chamber 50 and the third chamber 52 are connected through a connection channel 54.

The percussion piston 40 has an extension 55 that impacts a die, which is not shown, or a tool, which is also not shown.

An idle channel 56 branches off of the connection channel 54 that enables a connection between the first chamber 49 and the second chamber 50 in the idle position of the impact mechanism. An opening 57 to the connection channel 54 is covered by the percussion piston 40 in this case so that the communication between the second chamber 50 and the third chamber 52 is blocked off.

The rest of the design of the impact mechanism corresponds to the embodiment forms already described so that this does not have to be described again. Of course, the various configuration possibilities with regard to the connection channel and the control slide can also be transferred to this type of impact mechanism.

In other embodiment forms of the invention, the second chamber can also be a space with low volume dimensions that can be made to communicate with the connection channel, and sealed from the outside. This space can be located behind the drive piston and can contain at least a part of the drive unit for the drive piston.

What is claimed is:

1. A pneumatic impact mechanism comprising:

an impact mechanism housing;

a drive piston that is driven axially back and forth inside the impact mechanism housing;

a percussion piston that is located in front of a drive surface of the drive piston as seen in the direction of impact, and that moves axially coaxial with the drive piston;

a first chamber that is located in front of the drive surface of the drive piston and behind a rear surface of the percussion piston;

a second chamber that is formed behind the drive surface of the drive piston; and a third chamber that is formed in front of the rear surface of the percussion piston;

wherein the second chamber and the third chamber communicate with one another through a connection channel.

2. A pneumatic impact mechanism according to claim 1, wherein the drive piston moves inside the impact mechanism housing;

the drive surface of the drive piston is formed in a cavity of a front end face of the drive piston;

the percussion piston moves inside the cavity of the drive piston; and the first chamber is provided in the cavity of the drive piston.

3. A pneumatic impact mechanism according to claim 1, wherein the percussion piston moves inside the impact mechanism housing;

the rear surface of the percussion piston is formed in a cavity of a rear end face of the percussion piston;

the drive piston moves inside the cavity of the percussion piston; and the first chamber is provided in the cavity of the percussion piston.

4. A pneumatic impact mechanism according to claim 1, wherein an idle channel is provided that has at least one idle opening in a wall of the drive piston and that penetrates a wall of the impact mechanism housing.

5. A pneumatic impact mechanism according to claim 4, wherein the first chamber can be connected to the connection channel in an idle position via the idle channel.

6. A pneumatic impact mechanism according to claim 4, wherein the first chamber can be connected to the outside during idle operation through the idle channel.

7. A pneumatic impact mechanism according to claim 1, wherein the second chamber is located behind the drive piston.

8. A pneumatic impact mechanism comprising:

an impact mechanism housing;

a drive piston that is driven axially back and forth inside the impact mechanism housing;

a percussion piston that is located in front of a drive surface of the drive piston as seen in the direction of impact, and that moves axially coaxial with the drive piston;

a first chamber that is located in front of the drive surface of the drive piston and behind a rear surface of the percussion piston;

a second chamber that is formed behind the drive surface of the drive piston; and a third chamber that is formed in front of the rear surface of the percussion piston;

wherein the second chamber and the third chamber communicate with one another through a connection channel; and wherein the second chamber is located between a rear surface of the drive piston and a rear tubular base attached to the impact mechanism housing.

9. A pneumatic impact mechanism comprising:

an impact mechanism housing;

a drive piston that is driven axially back and forth inside the impact mechanism housing;

a percussion piston that is located in front of a drive surface of the drive piston as seen in the direction of impact, and that moves axially coaxial with the drive piston;

a first chamber that is located in front of the drive surface of the drive piston and behind a rear surface of the percussion piston;

a second chamber that is formed behind the drive surface of the drive piston; and a third chamber that is formed in front of the rear surface of the percussion piston;

wherein the second chamber and the third chamber communicate with one another through a connection channel; and wherein the third chamber is located between a front surface of the percussion piston and a front tubular base fastened to the impact mechanism housing.

10. A pneumatic impact mechanism comprising:

an impact mechanism housing;

a drive piston that is driven axially back and forth inside the impact mechanism housing;

a percussion piston that is located in front of a drive surface of the drive piston as seen in the direction of impact, and that moves axially coaxial with the drive piston;

a first chamber that is located in front of the drive surface of the drive piston and behind a rear surface of the percussion piston;

a second chamber that is formed behind the drive surface of the drive piston; and a third chamber that is formed in front of the rear surface of the percussion piston;

wherein the second chamber and the third chamber communicate with one another through a connection channel; and wherein the drive piston has a piston head forming the drive surface and the rear surface, a bracket configured to fasten to a drive unit, and a center member connecting the piston head to the bracket.

11. A pneumatic impact mechanism according to claim 10, wherein the rear tubular base is located between the piston head and the bracket of the drive piston and is penetrated by the center member of the drive piston.

12. A pneumatic impact mechanism comprising:

an impact mechanism housing;

a drive piston that is driven axially back and forth inside the impact mechanism housing;

a percussion piston that is located in front of a drive surface of the drive piston as seen in the direction of impact, and that moves axially coaxial with the drive piston;

a first chamber that is located in front of the drive surface of the drive piston and behind a rear surface of the percussion piston;

a second chamber that is formed behind the drive surface of the drive piston; and a third chamber that is formed in front of the rear surface of the percussion piston;

wherein the second chamber and the third chamber communicate with one another through a connection channel;

wherein an idle channel is provided that has at least one idle opening in a wall of the drive piston and that penetrates a wall of the impact mechanism housing;

wherein the first chamber can be connected to the connection channel in an idle position via the idle channel;

wherein an axially shifting control slide is provided that, in an impact position thereof, opens the connection channel and blocks off the idle channel and in an idle position blocks off the connection channel and opens the idle channel; and wherein the first and the second chambers communicate with one another.

13. A pneumatic impact mechanism comprising:

an impact mechanism housing;

a drive piston that is driven axially back and forth inside the impact mechanism housing;

a percussion piston that is located in front of a drive surface of the drive piston as seen in the direction of impact, and that moves axially coaxial with the drive piston;

a first chamber that is located in front of the drive surface of the drive piston and behind a rear surface of the percussion piston;

a second chamber that is formed behind the drive surface of the drive piston; and a third chamber that is formed in front of the rear surface of the percussion piston;

wherein the second chamber and the third chamber communicate with one another through a connection channel;

wherein an idle channel is provided that has at least one idle opening in a wall of the drive piston and that penetrates a wall of the impact mechanism housing;

wherein the first chamber can be connected to the outside during idle operation through the idle channel; and further comprising an axially shifting control slide that opens the connection channel and blocks off the idle channel in an impact position thereof and that blocks off the connection channel and opens the idle channel in an idle position thereof.

14. A method comprising:

moving a drive piston and a percussion piston of a pneumatic impact mechanism axially forward inside an impact mechanism housing to effect a strike stroke of said pneumatic impact mechanism, wherein, during the strike stroke;

movement of the drive piston compresses air and decreases the volume in a first chamber that is located in front of a drive surface of the drive piston and behind a rear surface of the percussion piston, movement of the drive piston and the percussion piston increases a combined volume of a second chamber that is formed behind the drive surface of the drive piston and a third chamber that is formed in front of the rear surface of the percussion piston and decreases pressure in the combined volume; and a pressure difference between the second and third chambers is eliminated by permitting air flow from the third chamber, through a communication channel connecting the second and third chambers to one another, and into the second chamber.

15. A method according to claim 14, further comprising:

moving the drive piston axially backward inside the impact mechanism housing to effect a return stroke, wherein, during the return stroke, the percussion piston moves axially backward with the drive piston via an air cushion;

the volume of the first chamber increases and a vacuum is induced therein;

the combined volume of the second and third chambers decreases and the pressure in the combined volume increases; and a pressure difference between the second and third chambers is eliminated by permitting air to flow from the second chamber, through the communication channel, and into the third chamber.

* * * * *